United States Patent [19]

Wedel et al.

[11] Patent Number: 4,823,688

[45] Date of Patent: Apr. 25, 1989

[54] CALENDERING APPARATUS USING INDUCTIVE HEATING FOR HOT-CALENDERING A PAPER WEB

[75] Inventors: Gregory L. Wedel, Beloit, Wis.; J. Larry Chance, Rockton, Ill.

[73] Assignee: Beloit Corporation, Beloit, Wis.

[21] Appl. No.: 84,714

[22] Filed: Aug. 10, 1987

[51] Int. Cl.[4] ..... B30B 15/34; B30B 3/04

[52] U.S. Cl. ..... 100/93 RP; 100/38; 219/10.61 R; 162/206

[58] Field of Search ..... 100/93 RP, 60, 163 R, 100/176, 917, 38; 219/10.57, 10.71, 10.73, 10.61 R, 10.79, 10.492; 162/206

[56] References Cited

U.S. PATENT DOCUMENTS

| | | | |
|---|---|---|---|
| 2,851,869 | 9/1958 | Quoos et al. | 100/160 X |
| 3,961,151 | 6/1976 | Danner | 219/10.79 X |
| 4,363,862 | 12/1982 | Giorgini | 100/176 |
| 4,384,514 | 5/1983 | Larive et al. | 100/93 RP |
| 4,570,044 | 2/1986 | Kobayashi et al. | 219/10.57 X |
| 4,590,347 | 5/1986 | Thatcher et al. | 219/10.57 X |
| 4,605,366 | 8/1986 | Lehmann et al. | 100/93 RP X |
| 4,610,617 | 9/1986 | Christ et al. | 100/93 RP |
| 4,614,565 | 9/1986 | Riihinen | 100/93 RP X |
| 4,647,744 | 3/1987 | Kitano et al. | 219/10.71 X |
| 4,653,395 | 3/1987 | Verkasalo | 100/38 |
| 4,748,906 | 6/1988 | Ashmore | 100/93 RP |
| 4,768,433 | 9/1988 | Boissevain | 100/93 RP |

FOREIGN PATENT DOCUMENTS 159337 4/1985 European Pat. Off. .

*Primary Examiner*—Andrew M. Falik

*Attorney, Agent, or Firm*—Dirk J. Veneman; Raymond W. Campbell; David J. Archer

[57] ABSTRACT

In a calendering apparatus for hot-calendering a paper web, the apparatus includes a rotatable calendering roll defining a smooth calendering surface. A backing roll rotatably cooperates with the calendering roll for defining therebetween a calendering nip for the passage therethrough of the web. An induction heater is disposed in close proximity to the calendering surface nip for inducing eddy currents within the calendering roll such that the calendering roll is heated. A blow box is disposed in close proximity to the calendering surface and between the heater and the nip. The blow box defines a plurality of compartments which are disposed in a cross-machine direction. Each of the compartments selectively blows a current of cooling air against the calendering surface for controlling the temperature of the calendering surface so that the temperature of the calendering surface adjacent to the nip is controlled in a cross-machine direction.

13 Claims, 2 Drawing Sheets

CALENDERING APPARATUS USING INDUCTIVE HEATING FOR HOT-CALENDERING A PAPER WEB

BACKGROUND OF THE INVENTION

1. FIELD OF THE INVENTION

This invention relates to a calendering apparatus for hot-calendering a paper web. More particularly, this invention relates to supercalendering and gloss calendering in which a web of paper extends through a calendering nip defined by a hard metal roll and a soft calender roll.

2. DESCRIPTION OF THE RELATED ART

In order to improve the finish of a dried web, the web of paper is pressed, or calendered, between a pair of cooperating rolls. Such calendering creates a smoother surface on the web and reduces the caliper, or thickness, of the web. Additionally, such calendering thermally bonds the fibers within the web. The aforementioned devices which include machine calenders, supercalenders and gloss calenders are utilized in the papermaking art to achieve the aforementioned required properties.

Research studies and practical experience have taught that the finishing operation on a paper web can be enhanced by heating at least one of the nipped rolls. Such heated roll then heats the web as it passes through the calendering nip and thereby effects the calendering action.

In order to provide the high roll surface temperatures required to enhance the calendering process, such rolls have been heated by hot water which is pumped through channels extending through the heatable roll. However, in a typical calendering roll, the roll shell is normally very thick in order to support the mechanical load of the nip. As a result of such thick shell, the water circulating through the calendering roll is unable to supply heat to the surface of the roll at a fast enough rate to maintain a high surface temperature. The aforementioned heating systems have generally only been successful when controlling the temperature at the edges of the roll where the heat flow is much smaller.

In an attempt to improve the rate of heat transfer to the roll surface, proposals have been made wherein the internal area of the roll has been fitted with a "displacer shell". "Displacer shells" act to reduce the cross sectional area for water flow and thereby increase the velocity of the water and produce a higher convective heat transfer coefficient. Nevertheless, the thick shell of the calendering roll still produces a significant resistance to heat transfer so that the gains made by the "displacer shell" are usually small. In the prior art, proposals have been set forth in an effort to further increase the temperature of the calendering roll by the utilization of oil in place of heated water. Such heating oil is sold under the Registered Trademark MOBILTHERM. MOBILTHERM is a Registered Trademark owned by Mobil Oil Corporation. Such heat transfer fluid can be heated to a temperature of between 500° to 550° Fahrenheit without the correspondingly high vapor pressure of water. Although these alternate heat transfer fluids create higher surface temperatures, they are still limited by the thick shell of the calendering roll in terms of temperature range and they also result in high shell thermal stresses.

In the prior art, another alternative has been proposed in which a series of axial holes are milled in the shell of the calendering roll. The shell is then covered with an outer surface sleeve so that the heat transfer fluid can circulate in the vicinity of the calendering surface. Those portions, or lands, between adjacent holes provide the mechanical support of the nip load so that the distance between the heated fluid and the roll surface can be greatly reduced. Alternatively, the surface of the shell is radially drilled with a plurality of holes. One drawback of the aforementioned proposals is that the heating of the surface of the calendering roll is not completely uniform in a circumferential direction. Additionally, there exist large thermal gradients in the shell which cause thermal stresses.

In addition to the aforementioned problems, another problem presents itself when operating a calender at elevated temperatures in that there exists a non-uniformity in the surface temperature in a cross-machine direction. Such surface temperature is influenced not only by variations in the web weight but also by moisture content and nip pressure. Also, the temperature of the web has a bearing on the cross-machine direction profile.

In the prior art, several proposals have been made utilizing external induction heating devices to supply the required thermal energy to the calendering roll. One example of an induction heated-calender is European patent application No. 159337 to Valmet. European patent application number 159337 recognizes the problem of controlling the cross-machine direction heating of the calendering roll. The solution of this problem, according to EP No. 159337, involves mounting each segment, or shoe, of an induction heating means so that each shoe can be selectively pivoted towards, or away from, the surface of the calendering roll thereby controlling the temperature of that portion of the roll adjacent to a particular shoe.

The aforementioned solution to the control of cross-machine direction temperature requires relatively complex mounting of each individual induction heater.

The present invention seeks to overcome the aforementioned problem by selectively directing a plurality of curtains of cooling air against the calendering surface of the calendering roll so that the cross-machine direction temperature adjacent to the calendering nip is controlled.

Therefore, it is a primary object of the present invention to provide a calendering apparatus that overcomes the aforementioned problems associated with the prior art hot-calendering arrangements and which provides a significant contribution to the paper calendering art.

Another object of the present invention is the provision of a calendering apparatus in which an air blowing means is disposed in close proximity to the calendering surface and between the heating means and the calendering nip with the blowing means defining a plurality of compartments disposed in a cross-machine direction. Each of the compartments selectively blows a current of cooling air against the calendering surface for controlling the temperature of the calendering surface so that the temperature of the calendering surface adjacent to the calendering nip is controlled in a cross-machine direction.

Another object of the present invention is the provision of a calendering apparatus having the aforementioned air blowing means and wherein the calendering roll includes a core, an annular insulating layer surrounding the core and a heatable annular shell surrounding the insulating layer such that eddy currents generated by means of an induction heater are localized in the heatable annular shell.

Another object of the present invention is the provision of an air gap between the core of the induction heater and the calendering surface, the air gap progressively increasing towards the side edges of the core in order to inhibit overheating of the lateral edges of the web.

Other objects and advantages of the present invention will be apparent to those skilled in the art by a consideration of the detailed description contained hereinafter taken in conjunction with the annexed drawings.

SUMMARY OF THE INVENTION

The present invention relates to a calendering apparatus and method for hot-calendering a paper web. The apparatus includes a rotatable calendering roll which defines a smooth calendering surface and a backing roll rotatably cooperating with the calendering roll for defining therebetween a calendering nip for the passage therethrough of the web. An induction heater is disposed in close proximity to the calendering surface for inducing eddy currents within the calendering roll such that the calendering roll is heated. Air blowing means is disposed in close proximity to the calendering surface and between the heater and the nip. The blowing means defines a plurality of compartments which are disposed in a cross-machine direction. Each of the compartments selectively blows a current of cooling air against the calendering surface for controlling the temperature of the calendering surface so that the temperature of the calendering surface adjacent to the nip is controlled in a cross-machine direction.

In a more specific embodiment of the present invention, the calendering roll is a solid, hard metal roll.

In an alternative embodiment of the present invention, the calendering roll includes a core and an annular insulating layer surrounding the core. A heatable annular shell surrounds the insulating layer with the shell defining the calendering surface.

The soft backing roll includes a soft outer cover and the induction heating means includes an electrical coil and a laminated core encompassing the coil. The core is fabricated from steel or steel laminates or, in an alternative embodiment of the present invention, the core is of a ferrite ceramic. More specifically, the core defines an air gap with the air gap being disposed between the core and the calendering surface. The air gap progressively increases towards the side edges of the core such that less heat is supplied to the calendering roll adjacent to the axial edges thereof so that overheating of the lateral edges of the web is inhibited.

The air blowing means in a specific embodiment of the present invention is a blow box with the blow box including a plenum chamber connected to a source of conditioned or ambient air. A fan blower blows the ambient air into the plenum chamber and selectively to one or more of the compartments. Nozzles are disposed adjacent to the calendering surface and in communication with one of the compartments of the plurality of compartments such that a curtain of air is selectively blown through the plenum chamber into that compartment and through the nozzle against the calendering surface for controlling the temperature of that portion of the calendering surface adjacent to the nozzle.

In a preferred embodiment of the present invention, each compartment includes at least one nozzle such that when air is selectively blown through that nozzle, the temperature of the calendering surface is controlled in the area next to the nozzle. The blow box also includes a valve for controlling the flow of air from the plenum chamber to the compartment and a valve actuator for controlling the valve. Connecting means extend between the actuator and the valve such that actuation of the actuator actuates the valve. The actuator may alternately be a stepping motor, a pneumatic diaphragm or a hydraulically-operated ram.

As will be apparent to those skilled in the art, many variations and modifications of the present concept can be carried out without departing from the spirit and scope of the present invention as defined by the appended claims.

BRIEF DESCRIPTION OF THE DRAWINGS

Similar reference characters refer to similar parts throughout the various figures of the drawings.

DETAILED DESCRIPTION OF THE INVENTION

Figure 1:
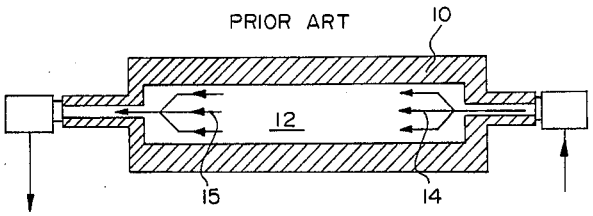
FIG. 1 is a cross sectional view of a prior art hollow calendering roll permitting the flow therethrough of a heating fluid.

FIG. 1 is a cross sectional view of a prior art hollow calendering roll 10 which defines a central cavity 12 for the passage therethrough of heated water as indicated by the arrows 14, 15.

Figure 2:
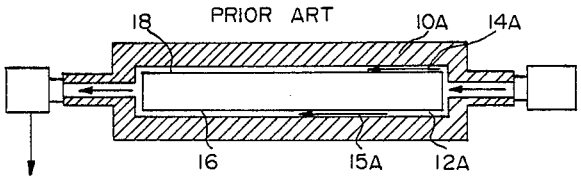
FIG. 2 is a cross sectional view of a prior art calendering roll showing a "displacer shell" disposed therein.

FIG. 2 is a cross sectional view of a prior art calendering roll 10A in which the central cavity 12A is partially filled by a displacer shell 16 such that a narrow flow passage 18 is defined between the displacer shell 16 and the calendering roll 10A for the passage therethrough of heated water indicated by the arrows 14A, 15A.

Figure 3:
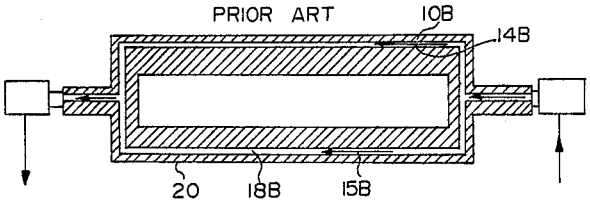
FIG. 3 is a cross sectional view of a prior art calendering roll showing a plurality of fluid flow channels extending along the length thereof in the vicinity of the calendering surface.

FIG. 3 is a cross sectional view of a prior art calendering roll 10B in which a plurality of fluid flow channels 18B extend axially through the calendering roll 10B in the vicinity of the calendering surface 10B so that heating fluid indicated by the arrows 14B, 15B heat the calendering surface 20.

Figure 4:
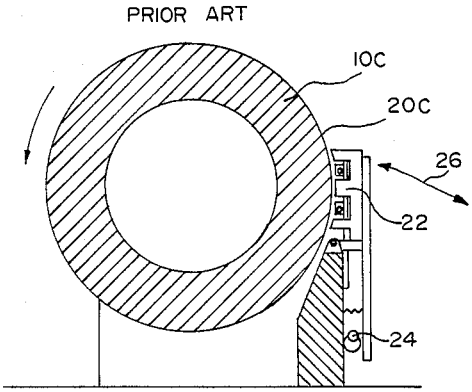
FIG. 4 is a sectional view of a prior art heated calendering roll showing an induction heater shoe selectively pivotable relative to the calendering surface of the roll.

FIG. 4 is a sectional view of a prior art heated calendering roll 10C as shown in European patent application number 159337. FIG. 4 shows the rotatable calendering roll 10C and a plurality of induction heater shoes 22. The shoes 22 are pivotable around a pivotal axis 24 so that by moving the individual shoes 22 towards or away from the calendering surface 20C as indicated by the arrow 26 heating of the calendering roll 10C in a cross-machine direction can be controlled.

Figure 5:
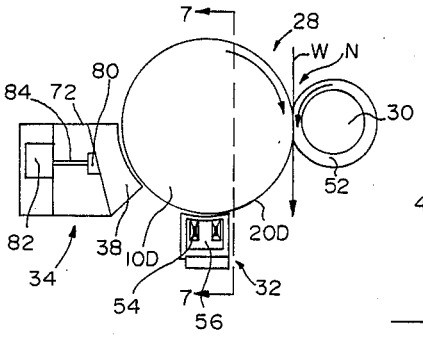
FIG. 5 is a side-elevational view of the calendering apparatus according to the present invention showing the induction heater and the air blowing means.

FIG. 5 is a cross sectional view of a calendering apparatus generally designated 28 according to the present invention for hot-calendering a paper web W. The calendering apparatus 28 includes a rotatable calendering roll 10D which defines a smooth calendering surface 20D. A soft backing roll 30 rotatably cooperates with the calendering roll 10D for defining therebetween a calendering nip N for the passage therethrough of the web W. Alternatively, the backing roll may be a hard roll.

An induction heating means generally designated 32 is disposed in close proximity to the calendering surface 20D and upstream relative to the nip N for inducing eddy currents within the calendering roll 10D such that the calendering roll 10D is heated.

An air blowing means generally designated 34 is disposed in close proximity to the calendering surface 20D and between the heating means 32 and the nip N. The blowing means 34 defines a plurality of compartments 36,37,38 as shown more particularly with reference to FIG. 6. The compartments 36 to 38 are disposed in a cross-machine direction indicated by the arrow 40. Each of the compartments 36 to 38 selectively blows a current of cooling air indicated by the arrows 42,43,44 against the calendering surface 20D for controlling the temperature of the calendering surface 20D so that the temperature of the calendering surface 20D adjacent to the nip N is controlled in a cross-machine direction.

Figure 6:
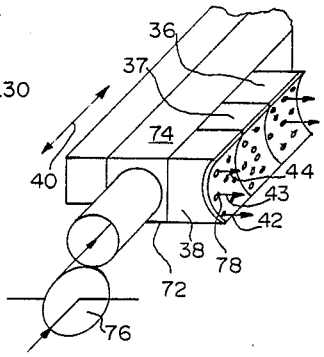
FIG. 6 is a perspective fragmentary view of the air blowing means shown in FIG. 5 showing the plenum chamber and the plurality of compartments.
Figure 7:
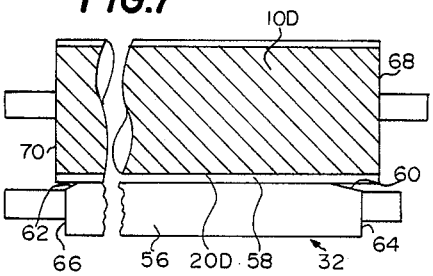
FIG. 7 is a sectional view taken on the line 7–7 of FIG. 5 showing the air gap increasing towards the respective side edges of the core.

In the embodiment shown in FIGS. 5 to 7, the calendering roll 10D is a solid, hard metal roll.

Figure 8:
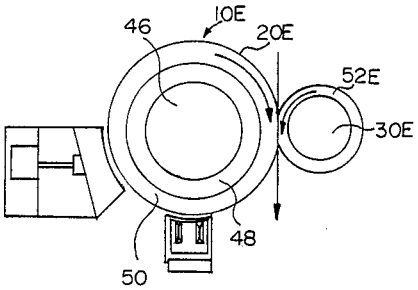
FIG. 8 is a side elevational view similar to figure 5 but showing an alternative embodiment of the present invention with the calendering roll having a core, an insulating layer and a heatable shell.

In an alternative embodiment of the present invention as shown in FIG. 8, a calendering roll generally designated 10E includes a core 46 and an annular insulating layer 48 which surrounds the core 48. A heatable annular shell 50 surrounds the insulating layer 48 with the shell 50 defining a calendering surface 20E.

In the embodiments of both FIGS. 5 to 7 and 8, the soft backing rolls 30 and 30E respectively, include soft outer covers 52 and 52E respectively.

The induction heating means 32 includes, as shown in FIGS. 5 and 7, an electrical coil 54 and a laminated core 56 which encompasses the coil 54. The core 56 may be fabricated from steel or from a ferrite ceramic.

As shown more particularly in FIG. 7, the core 56 defines an air gap 58. The air gap 58 is disposed between the core 56 and the calendering surface 20D. The air gap 58 progressively increases as shown at 60 and 62 respectively towards the side edges 64 and 66 of the core 56 such that less heat is supplied to the calendering roll 10D adjacent to the axial edges and respectively thereof so that overheating of the lateral edges of the web is inhibited.

FIG. 6 shows the air blowing means 34 as being a blow box 72 which includes a plenum chamber 74 connected to a source of ambient air. A fan blower 76 blows ambient or conditioned air from the plenum chamber 74 selectively to one or more of the compartments 36 to 38. A nozzle 78 is disposed adjacent to the calendering surface 20D and in communication with one of the compartments 38 of the plurality of compartments 36 to 38 such that a curtain of air 42 to 44 is selectively blown through the plenum chamber 74 into the compartment 38 and through the nozzle 78 against the calendering surface 20D for controlling the temperature of that portion of the calendering surface 20D adjacent to the nozzle 78.

As shown in FIG. 6, each compartment 36 to 38 includes at least one nozzle such that when air is selectively blown through the nozzles, the temperature of the calendering surface 20D is controlled in the area adjacent to the nozzle thereby controlling the surface temperature in a cross-machine direction.

. As shown in FIG. 5, the air blowing means 34 specifically includes a valve 80 for controlling the flow of air from the plenum chamber 74 to the compartment 38. A valve actuator 82 controls the valve 80 and connecting means 84 extend between the actuator 82 and the valve 80 such that actuation of the actuator 82 operates the valve 80. The actuator 82 may alternately be a stepping motor, a pneumatic diaphragm, a hydraulically-operated ram, or an electrical solenoid.

In operation of the calendering apparatus according to the present invention, the heating means 32 is energized such that eddy currents are generated within the heatable calendering roll 10D. Due to various factors including variations in moisture content of the web W, different temperatures are required in a cross-machine direction in order to compensate for such variations in the profile of the web to be calendered. Accordingly, such requirements are determined by sensing means (not shown) such that control signals are sent to the actuators 82 so that the amount of air ejected through the nozzles in a cross-machine direction may be varied to compensate for the aforementioned irregularities in the moisture content of the web.

By the foregoing means, the temperature of the calendering roll may exceed 250° Fahrenheit over the entire cross-machine direction. The surface temperature profile of the calendering roll is permanently adjusted by adjusting the disposition of the induction heater relative to the calendering roll. Such adjustments can be made to correct stable and persistent non-uniformities in the web. The profile is then selectively adjusted by application of the high velocity impinging air jets directed towards the calendering surface. This selective adjustment is used for "on-the-run" operation and fine-tuning. Furthermore, the soft backing roll is insulated from the hot-calendering roll by the web disposed therebetween. The induction heater is a simple high current water-cooled coil which extends axially adjacent to the calendering roll.

The foregoing invention provides a simple and effective means for controlling the heat available for transfer to the web to be calendered such that a calendered web of uniform profile is produced.

What is claimed is:

1. A calendering apparatus for hot calendering a paper web, said apparatus comprising:

a rotatable calendering roll defining a smooth calendering surface;

a backing roll rotatably cooperating with said calendering roll for defining therebetween a calendering nip for the passage therethrough of the web;

induction heating means disposed in close proximity to said calendering surface for inducing eddy currents within said calendering roll such that said calendering roll is uniformly heated in a cross-machine direction;

air blowing means disposed in close proximity to said calendering surface and downstream relative to said heating means, said blowing means defining a plurality of compartments disposed in a cross-machine direction, each of said compartments selectively blowing a current of cooling air against said calendering surface for controlling the temperature of said calendering surface such that the average temperature at said nip is lower than the temperature of said surface during passage of said surface part said heating means so that the temperature of said calendar surface adjacent to said nip is controlled in a cross-machine direction said calendering roll further including;

a core;

an annular insulating layer surrounding said core; and a heatable annular shell surrounding said insulating layer, said shell defining said calendering surface.

2. A calendering apparatus as set forth in claim 1 wherein said calendering roll is a solid, hard metal roll.

3. A callendering apparatus as set forth in claim 1 wherein said backing roll includes a soft outer cover.

4. A calendering apparatus as set forth in claim 1 wherein said induction heating means includes;

an electrical coil;

a core encompassing said coil.

5. A calendering apparatus as set forth in claim 4 wherein said core is laminated.

6. A calendering apparatus as set forth in claim 4 wherein said core is of steel.

7. A calendering apparatus as set forth in claim 4 wherein said core is a ferrite ceramic.

8. A calendering apparatus as set forth in claim 1 wherein said air blowing means is a blow box, said blow box including:

a plenum chamber connected to a source of air;

a fan blower for blowing said air from said plenum chamber selectively to one or more of said compartments;

a nozzle disposed adjacent to said calendering surface and in communication with one of said compartments of said plurality of compartments such that a curtain of air is selectively blown through said plenum chamber into said compartment and through said nozzle against aid calendering surface for controlling the temperature of that portion of said calendering surface adjacent to said nozzle.

9. A calenering apparatus as set forth in claim 8 wherein said air blowing means further includes:

a valve for controlling the flow of air from said plenum chamber to said compartment;

a valve actuator for controlling said valve;

connecting means extending between said actuator and said valve such that actuation of said actuator operates said valve.

10. A calendering apparatus as set forth in claim 1 wherein each compartment includes at least one nozzle such that when air is selectively blown through said nozzles, the temperature of said calendering surface is controlled in the cross-machine direction.

11. A calendering apparatus for hot-calendering a paper web, said apparatus comprising:

a rotatable calendering roll defining a smooth calendering surface;

a backing roll rotatably cooperating with said calendering roll for defining therebetween a calendering nip for the passage therethrough of the web;

induction heating means disposed in close proximity to said calendering surface for inducing eddy currents within said calendering roll such that said calendering roll is heated;

said induction heating means including:

an electrical coil;

a core encompassing said coil;

said core defining an air gap, said air gap being disposed between said core and said calendering surface, said air gap progressively increasing towards the side edges of said core such that less heat is supplied to said calendering roll adjacent to the axial edges thereof so that overheating of the lateral edges of the web is inhibited; and air blowing means disposed in close proximity to said calendering surface and between said heating means and said nip, said blowing means defining a plurality of compartments disposed in a cross-machine direction, each of said compartments selectively blowing a current of cooling air against said calendering surface for controlling the temperature of said calendering surface so that the temperature of said calendering surface adjacent to said nip is controlled in a cross-machine direction.

12. A calendering apparatus for hot calendering a paper web, said apparatus comprising:

a rotatable calendering roll defining a smooth calendering surface;

a backing roll rotatably cooperating with said calendering roll for defining therebetween a calendering nip for the passage therethrough of the web;

induction heating means disposed in close proximity to said calendering surface for inducing eddy currents within said calendering roll such that said calendering roll is uniformly heated in a cross-machine direction;

an air blow box disposed in close proximity to said calendering surface and between said heating means and said nip, said blow box being disposed downstream relative to said heating means, said blow box defining a plurality Of compartments disposed in a cross-machine direction, each of said compartments defining at least one nozzle permitting selective blowing of a current of cooling air against said calendering surface for controlling the temperature of said calendering surface such that the average temperature at said nip is lower than the temperature of said surface during passage of said surface part said heating means so that the temperature of said calendering surface adjacent to said nip is controlled in a cross-machine direction;

said calendering roll including:

a core;

an annular insulating layer surrounding said core; and a heatable annular shell surrounding said insulating layer, said shell defining said calendering surface.

13. A method of calendering a web comprising the steps of:

inductively heating a calendering roll upstream relative to a calendering nip defined by the calendering roll and a backing roll such heating being uniform in a cross-machine direction; and applying between the inductive heating and the nip, a cooling curtain of air selectively along a cross-machine direction of the calendering roll such that the temperature of the calendering roll adjacent to the nip is controlled in a cross-machine direction such that the average temperature at the nip is lower than the temperature at the surface of the roll during passage of the surface past the inductive heating so that irregularities in the moisture content, weight, smoothness and caliper of the web are compensated for during calendering.

* * * * *

UNITED STATES PATENT AND TRADEMARK OFFICE

CERTIFICATE OF CORRECTION

PATENT NO. : 4,823,688

DATED : April 25, 1989

INVENTOR(S) : Gregory L. Wedel and J. Larry Chance

It is certified that error appears in the above-identified patent and that said Letters Patent is hereby corrected as shown below:

Column 7, line 45, Claim 9, delete "calenering" and insert therefor --calendering--.

Signed and Sealed this

Twenty-third Day of January, 1990

*Attest:*

JEFFREY M. SAMUELS

*Attesting Officer* *Acting Commissioner of Patents and Trademarks*